United States Patent [19]

Ott

[11] 3,974,820

[45] Aug. 17, 1976

[54] CATAPULT DEVICE

[76] Inventor: Peter Paul Ott, 237 Canyon Acres Drive, Laguna Beach, Calif. 92651

[22] Filed: Mar. 10, 1975

[21] Appl. No.: 556,662

[52] U.S. Cl. ..... 124/20 R; 224/2 R; 124/41 R

[51] Int. Cl.[2] ..... F41B 7/00

[58] Field of Search ..... 124/20 R, 30 R, 41 R; 224/2 E, 2 F, 2 B, 2 R; 30/151, 153

[56] References Cited

UNITED STATES PATENTS

| | | | |
|---|---|---|---|
| 1,633,319 | 6/1927 | Estwing | 224/2 E |
| 2,625,926 | 1/1953 | Foster | 124/20 R |
| 2,672,857 | 3/1954 | Gauthier | 124/20 R |
| 2,825,323 | 3/1958 | Huszar | 124/20 R |
| 3,494,346 | 2/1970 | Yount et al. | 124/20 R |
| 3,614,947 | 10/1971 | Feldman | 124/20 B |
| 3,707,250 | 12/1972 | Esposito | 224/2 B |
| 3,749,075 | 7/1973 | Saunders | 124/20 R |

*Primary Examiner*—Richard C. Pinkham
*Assistant Examiner*—William R. Browne
*Attorney, Agent, or Firm*—William C. Babcock

[57] ABSTRACT

A portable catapult device that includes a wishbone shaped frame defined by an elongate shank and two laterally spaced forwardly disposed arms. The whole device composed of a molded one piece design. The arms support two transversely slotted heads. The slotted heads are removably engaged by two elongate elastic members in such a manner that when the members are tensioned by being drawn rearwardly and then released, a pouch connected to the rearward ends of the members in which a projectile is disposed in a self-centering position is propelled forwardly to remain in contact with the projectile until the pouch moves forwardly beyond the arms to a position that is substantially the length of the members. Due to the pouch remaining in contact with the projectile for the maximum length of travel, the projectile is discharged from the pouch with the maximum velocity possible with the particular resilient members that are used. The shank functions as a shield for the forearm of a user.

5 Claims, 7 Drawing Figures

FIG. 4
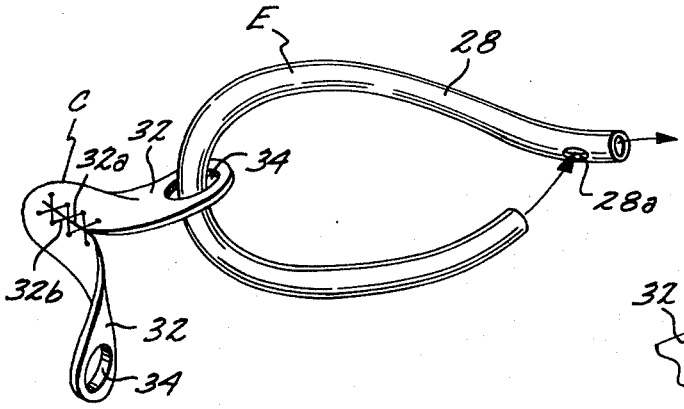
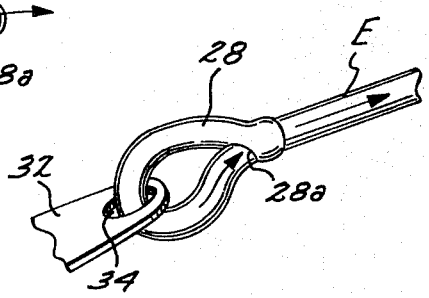
FIG. 5
FIG. 6
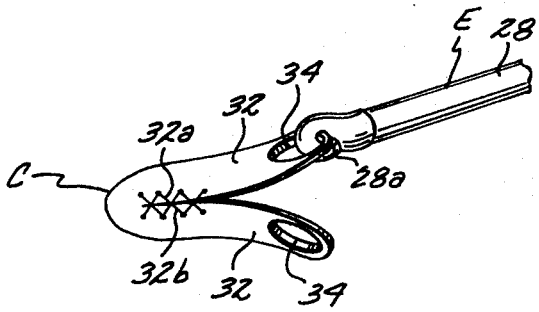
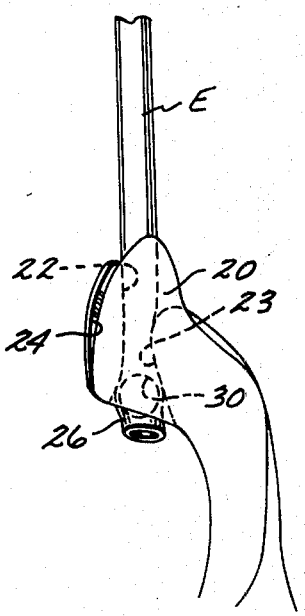
FIG. 7

CATAPULT DEVICE

BACKGROUND OF THE INVENTION

Field of the Invention

A hunting catapult device.

Description of the Prior Art

Due to the increased population density, many areas that contain game are closed to hunters that use firearms. As a result, numerous hunters have resorted to a primitive weapon such as a bow and arrows to be able to take game in such areas. However, a bow and arrows is an assembly that is bulky and cumbersome to carry, and particularly difficult to maneuver and use in an area wholly or partially covered with brush. More important its design allows for the development of substantially more impact and accuracy than similar available devices.

The primary object of the present invention is to provide an elastic actuated catapult that is portable, compact, light in weight, and easily carried in a brush covered area where game abounds but in which area the use of firearms is prohibited.

Another object of the invention is to supply a catapult in which the projectile automatically assumes a centered position in a pouch irrespective of whether the projectile is a single pellet, dart, or a number of buckshot.

A further object of the invention is to supply a catapult in which the elastic members are easily and quickly changed, and the frame portion of the invention serving not only as a steady rest for the user as the pouch is drawn to a projectile discharging position, but as a shield for the hand and wrist of the user most adjacent the frame of the invention during the discharge of the projectile.

SUMMARY OF THE INVENTION

A portable catapult device that includes a wishbone shaped frame defined by an elongate shank and two laterally spaced forwardly disposed arms. The arms on their forward extremity develop into two transversely spaced slotted heads that are adapted to receive two elongate resilient members having enlarged first ends, which first ends bear against rearward surfaces defined on the heads. The resilient members extend forwardly through funnel shaped orifices in the heads, around forward portion of the heads, and then rearwardly along adjacent interior surfaces of the heads, with second ends of the resilient members secured to opposite sides of a tapered pouch of such structure that the projectile or projectiles disposed therein automatically assume centered positions.

The arms on their inner edges develop into a pair of flanges that extend rearwardly to merge into a depending pistol type grip. The end of the shank most remote from the grip develops into a transverse arcuate cross piece. When the grip is grasped the flanges serve as rests for the thumb and forefinger, with the cross piece when the device is so held being forced into pressure contact with the forearm of the user as the pouch is moved rearwardly to tension the two resilient members. When the pouch is released, the resilient members will catapult it and the projectile situated in a centered position therein forwardly, with the pouch remaining in engagement with the projectile until after the latter has moved forwardly between the arms to substantially the length of the elongate members forwardly therefrom. Due to the elastics being first wrapped around the heads then tensioned rearwardly, the pouch containing the projectile when released is thereby instantly snapped completely through the fork formed by the limbs and into its original forward extending attitude with the pouch then flipped inside out toward the target thus completing an absolute and complete follow-through. Due to the pouch remaining in contact with the projectile during the maximum length of travel of the contracting resilient members, maximum velocity is imparted to the projectile prior to it separating from the pouch. The pouch assures that the projectile will be centered automatically to assure maximum accuracy in the use of the device.

BRIEF DESCRIPTION OF THE DRAWINGS

FIG. 4 is a perspective view of a rearward portion of an elastic hose looped through an opening in a side wall of a pouch;

FIG. 5 is a persepctive view of a rearward portion of the hose formed to define a loop;

FIG. 6 is the same view as shown in FIG. 5 but with the loop tightened; and FIG. 7 is a perspective view of one of the heads and forward end of the hose removably supported therein.

DESCRIPTION OF THE PREFERRED EMBODIMENT

Figures 1, 2, 3:
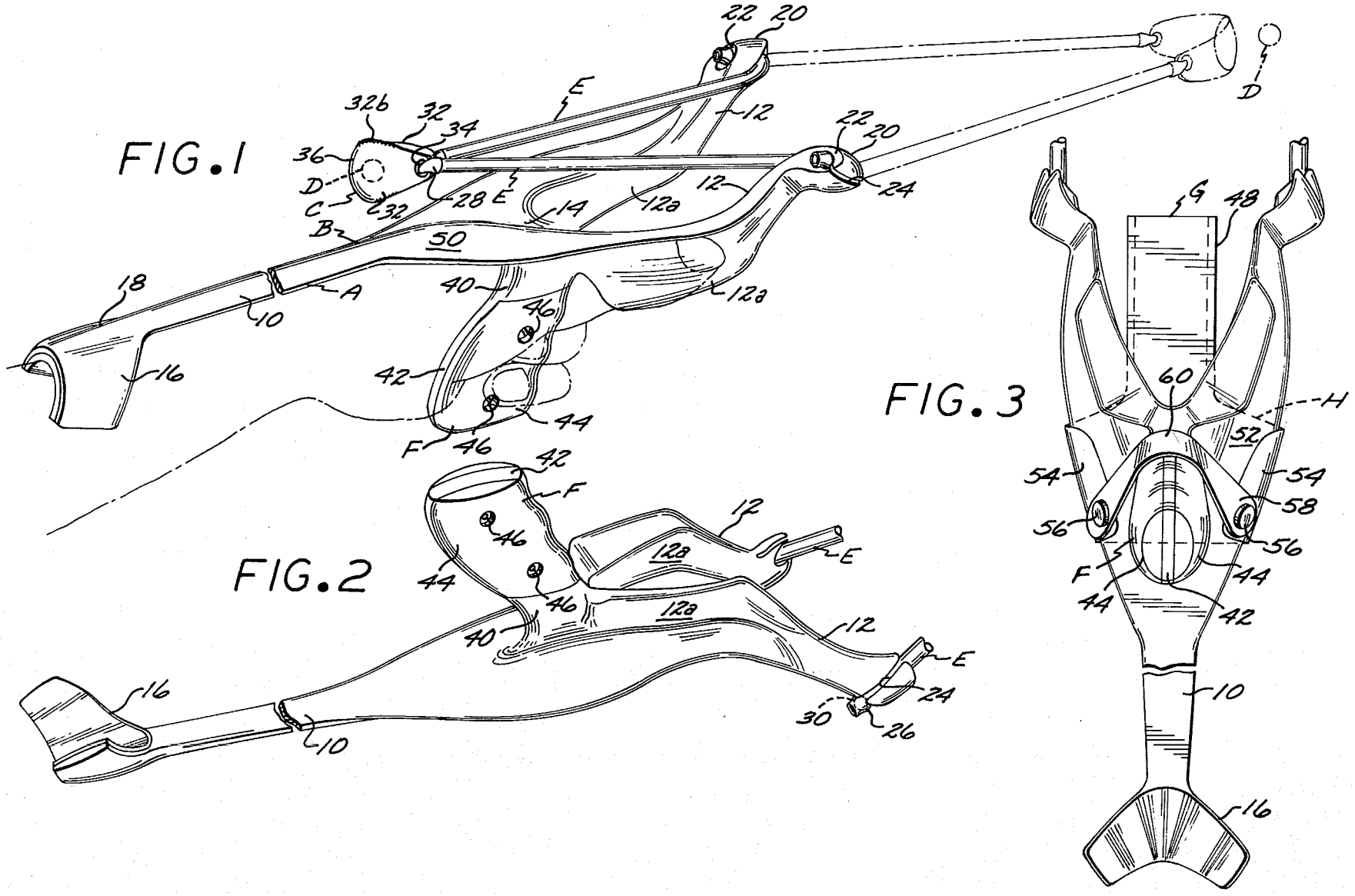
FIG. 1 is a perspective view of the catapult device in a position where it is grasped by the hand of a user shown in phantom line.
FIG. 2 is a second perspective view of the catapult device in an inverted position.
FIG. 3 is a side elevational view of the catapult device removably supported in a holder that may be removably secured to the belt of a user.

The catapult device A of the present invention as may best be seen in FIGS. 1 and 2 of the drawing, includes a rigid frame B, a pouch C in which a projectile D is disposed in a central position, and two elongate elastomeric members E connected to opposite forward side portions of the pouch and to the forward extremities of the frame.

The frame B is defined by an elongate shank 10 of arcuate transverse cross section that has a pair of laterally spaced arms 12 projecting forwardly from a first end 14 thereof as shown in FIG. 1. An arcuate cross piece 16 is supported in a fixed position from a second end 18 of shank 10.

A pair of heads 20 are supported in fixed positions on the forward extremities of arms 12. Each of the heads 12 has a longitudinal bore 22 therein that has a rearwardly disposed funnel shaped end 23, and each bore 22 being in communication with a longitudinal slot 24 formed in an external side surface of the head.

The members E are length of rubber surgical hose that have first forward ends 26 and rearward second ends 28. The first ends 26 are expanded transversely by ball bearings 30 inserted therein that are of such diameter that the first ends 26 are radially expanded to the extent that they will not pass forwardly through the funnel shaped ends 23 of bores 22.

The expanded first ends 26 are seated in the funnel shaped ends 23, with the members E extending forwardly through bores 22, then transversely around the forward ends of the heads, and rearwardly along internal side surfaces of the heads. The pouch C is formed from a strip of sheet material of a pliable nature such as leather or the like. The strip is folded to define two sidepieces 32 that taper rearwardly and outwardly, and at their rearward ends have a transverse cut 32*a* therein that is held together by thread stitching 32*b*. The side pieces 32 on their forward portions have transversely aligned openings 34 therein.

The rearward end portions 28 of members E have longitudinal slits 28*a* therein as shown in FIG. 4. Rearward end portions 28 are passed through openings 34 as shown in FIG. 4 to form loops, with the free ends of the hose defining the loops being passed through slits 28*a*, and then pulled forwardly through the hose as shown in FIGS. 4 and 5 to tighten the loops and secure the pouch to the lengths of hose E. The forward ends 26 of the hose E are enlarged by ball bearings 30 as previously described.

The arms 20 as may be seen in FIG. 1 have longitudinally extending flanges 12*a* extending downwardly therefrom, and the flanges at the rearward portion thereof merging into a body 40 that develops into a downwardly extending pistoltype handle 42 that has grips 44 secured to opposite sides thereof and held in place thereon by screws 46 or other suitable fastening means. The handle 42, grips 44 and screws 46 in combination constitute a pistol grip F.

The catapult device A is used by a right handed individual, as can be seen in FIG. 1, by the left hand of the user grasping the handle F, and with the thumb of the user extending longitudinally along the right hand flange 12*a* as shown in FIG. 1, and the forefinger of the hand along the left hand position flange 12*a*. When the catapult device A is so held, the elongate shank 10 will extend over the forearm of the user, and with the cross piece 16 in pressure contact with the forearm. A left handed individual holds the device with the right hand and draws with the left.

When the pouch C is drawn rearwardly by the right hand of the user to tension the elongate members E, as the catapult device A is held by the left hand of the user, the device A will tend to pivot in such a direction in the user's hand as to force the cross piece 16 into pressure contact with the forearm of the user. The catapult device A when held as shown in FIG. 3 occupies a steady position, for not only is it gripped by the hand of the user engaging the handle F, but the thumb and forefinger extend along the flanges 12*a*, and the cross piece 16 is in engagement with the forearm of the user.

It will be particularly noted in FIG. 1 that as the pouch C is released from a rearward position in which the elastic members E are tensioned, that the elastic members will tend to contract longitudinally and cause the pouch C and projectile D to move forwardly between the arms 12 to the position shown in phantom line in FIG. 1 after which the projectile D is released. It will be apparent that in the operation of the catapult device A, the projectile D remains in contact with the pouch C for maximum length of travel prior to being released, and as a result the velocity of the projectile is substantially higher than that attainable with present day sling shots or catapult devices. The slots 24 in heads 20 permit the easy insertion and removal of members E from bores 22 in heads 20.

A carrier G is provided as shown in FIG. 3 that includes a loop defining strap 48 that may removably engage a belt (not shown) of a user and the strap on the lower end thereof developing to a receptacle H that in which a portion 50 of frame B may be disposed. The receptacle H includes a wall 52 that has two flanges 54 extending downwardly along the sides thereof and outwardly spaced from the wall 52. The flanges 54 preferably support male snap sections 56 that removably engage female snap sections 58 formed in a strap 60 that extends between the snaps and over the handle F. Strap 60 removably maintains the catapult A in receptacle H.

The use and operation of the invention has been explained previously in detail and need not be repeated.

I claim as my invention:

1. A portable hunting catapult device that may be carried by a user, said device of the type that includes a pouch having two spaced sidewalls capable of having a projectile disposed therebetween, two elongate laterally spaced elastomeric members that are secured to said side walls and extend forwardly therefrom, said members having forwardly disposed enlarged first end portions, as well as second end portions, and a wishbone shaped frame that includes an elongate shank having first and second ends and two laterally spaced arms that project forwardly from said first end, the improvement in said frame that includes:

a. two heads mounted on the forward extremities of said arms, said heads including external and interior side surfaces and forwardly disposed end surfaces, said heads having longitudinal bores therein that have funnel shaped rearward portions of such transverse cross section that said enlarged first end portions cannot pass therethrough when said elastomeric members extend forwardly through said bores to extend transversely across said end surfaces and then rearwardly along said exterior side surfaces to said pouch to which said second end portions are attached to said sidewalls thereof, said members after being tensioned by rearward movement of said pouch and projectile and subsequently released propelling said pouch and projectile forwardly between said arms, with said pouch remaining in contact with a projectile until said members have traveled forwardly from said arms substantially the length of said members in an untensioned condition, and a projectile having maximum velocity imparted thereto due to remaining in contact with said pouch for the maximum distance of travel;

b. a pistol type handle that depends from said shank rearwardly of said arms;

c. a cross piece supported from said second end of said shank that is forced into pressure contact with the forearm of a user when the hand associated with said forearm grasps said handle and said pouch is pulled rearwardly to tension said members;

d. two laterally spaced flanges that depend from said arms and that are pressure contacted by a thumb and forefinger of a user when a hand grasps said handle; and said shank is of arcuate transverse cross section and serves as a shield when overlying said forearm of a user.

2. A catapult device as defined in claim 1 in which said elastomeric members are surgical hose and said catapult device in addition including:

e. two first spherical bodies are disposed in said hose causing the enlargements in said forwardly disposed first end portions.

3. A catapult device as defined in claim 2 in which said second end portions of said members are formed into loops that engage openings in said sidewalls of said pouch to support said pouch from said members.

4. A catapult device as defined in claim 1 that includes:

e. a receptacle for removably engaging a portion of said arms and shank at the junction thereof;

f. said receptacle including first means for removably supporting said receptacle from a portion of the garment of a user; and g. second means for removably locking said catapult device in said receptacle in a carrying position.

5. A catapult device as defined in claim 4 in which said first means removably engages a belt of a user.

* * * * *